US008615916B2

(12) United States Patent
Bassoli et al.

(10) Patent No.: US 8,615,916 B2
(45) Date of Patent: Dec. 31, 2013

(54) THERMAL BARRIER FOR FIREARMS AND FIREARM PROVIDED WITH SUCH A THERMAL BARRIER

(75) Inventors: Marco Bassoli, Gardone Val Trompia (IT); Eugenio Righi, Brescia (IT); Ugo Ansaldi, Inzino (IT)

(73) Assignee: Fabbrica d'Armi Pietro Beretta S.p.A., Gardone Val Trompia (IT)

( * ) Notice: Subject to any disclaimer, the term of this patent is extended or adjusted under 35 U.S.C. 154(b) by 26 days.

(21) Appl. No.: 13/334,965

(22) Filed: Dec. 22, 2011

(65) Prior Publication Data

US 2013/0055616 A1 Mar. 7, 2013

(30) Foreign Application Priority Data

Sep. 2, 2011 (IT) ..... MI11A001578

(51) Int. Cl.
*F41A 35/02* (2006.01)
*F41A 21/48* (2006.01)

(52) U.S. Cl.
USPC ..... 42/96; 42/75.02

(58) Field of Classification Search
USPC ..... 42/96, 75.02, 76.02; 89/14.1, 16
See application file for complete search history.

(56) References Cited

U.S. PATENT DOCUMENTS

| | | | | |
|---|---|---|---|---|
| 2,312,150 | A | 2/1943 | Conner | |
| 3,742,640 | A | 7/1973 | Thomsen | |
| 5,608,982 | A * | 3/1997 | Bouvard et al. | 42/84 |
| 6,908,660 | B2 * | 6/2005 | Bauer et al. | 428/163 |
| 6,979,758 | B2 * | 12/2005 | Eidelman et al. | 588/403 |
| 7,464,496 | B1 * | 12/2008 | Davies et al. | 42/75.02 |
| 7,501,551 | B2 * | 3/2009 | Eidelman et al. | 588/403 |
| 7,665,396 | B1 * | 2/2010 | Tippmann, Jr. | 89/7 |
| 7,943,227 | B2 * | 5/2011 | Connelly | 428/166 |
| 2007/0256345 | A1 * | 11/2007 | Hall et al. | 42/76.1 |
| 2010/0186582 | A1 * | 7/2010 | Juarez | 89/191.01 |
| 2011/0119983 | A1 * | 5/2011 | Muller | 42/79 |
| 2013/0061503 | A1 * | 3/2013 | Klett et al. | 42/76.01 |

FOREIGN PATENT DOCUMENTS

| | | |
|---|---|---|
| DE | 10 2007 04572 | 4/2009 |
| WO | WO 2005/121686 | 12/2005 |

OTHER PUBLICATIONS

European Search Report dated Apr. 27, 2012 in European Application No. 11 195 424.4.
Italian Office Action dated Sep. 9, 2011 in Italian Application No. ITM120111578 w/English Translation.

* cited by examiner

*Primary Examiner* — Bret Hayes
(74) *Attorney, Agent, or Firm* — Oblon, Spivak, McClelland, Maier & Neustadt, L.L.P.

(57) ABSTRACT

A thermal barrier (1) for firearms (A) comprising a body (2), optionally substantially cylindrical, made of a ceramic material. The body (2) is shaped and configured for being placed between a respective barrel (C) of a firearm (A) and at least one structure (S) of the firearm (A). The body (2) of the thermal barrier (1) has a first portion (3) suitable for remaining facing the barrel (C) of the respective firearm (A), and a second portion (4) facing the side opposite with respect to the first portion (3), optionally suitable for bearing upon at least one portion of the structure (S) of the firearm (A).

9 Claims, 6 Drawing Sheets

THERMAL BARRIER FOR FIREARMS AND FIREARM PROVIDED WITH SUCH A THERMAL BARRIER

The present invention refers to a thermal barrier for firearms.

Further it is an object of the present invention a firearm provided with the aforementioned thermal barrier.

As known, the receivers of firearms, in particular of assault rifles, constitute the structure to which both the respective metal barrels and a series of auxiliary devices and members necessary for firearms to function correctly are fixedly connected.

In order to make the structures of assault rifles and/or of carbines lighter, it is common practice to replace the metal parts with components made of a polymeric material, of the type with high thermal resistance, as well as with high resistance to the stresses generated during the firing action.

As known, polymeric material is generally used both to make the receiver, and to make intermediate components situated between the barrel of the respective firearms and the main structure.

Thanks to the use of polymeric material it is possible to substantially lighten the aforementioned firearms that, since they are no longer made from purely metal materials, are particularly easy to be transported and handled during armed actions.

In addition, the elasticity of the polymeric material normally used significantly increases the lifetime of the aforementioned firearms, which are less subject to damage or breaking due to the stresses and/or vibrations that are generated during the firing action. Although the use of the aforementioned polymeric material permits the aforementioned firearms to be significantly lightened, the Applicant has found that firearms having one or more structure made of polymeric material are not without drawbacks and can be improved in various aspects, mainly in relation to the resistance of the structure to high operating temperatures, to the structural integrity of the firearms, as well as to the safety of users when they operate in high performance conditions.

In particular, the Applicant has found that during firing, in a condition of exceeding the normal operating limit of the firearm, the structure tends to overheat, with the risk of melting of some portions made of polymeric material.

The exposure of the polymeric material to temperatures above the permitted limit tends to significantly weaken the structure of the aforementioned firearms.

Of course, the great heat dissipated during the use of the aforementioned firearms, as well as the structural weakening undergone by the polymeric material due to the excessive operating heat, have a substantial impact on the safety of the users during military operations and/or acts of war.

The main purpose of the present invention is to make a thermal barrier for firearms that is able to solve the problems encountered in the prior art.

A further purpose of the present invention is to propose a thermal barrier for firearms that is able to thermally insulate the structures made of polymeric material of the firearms from the respective barrels.

Another purpose of the present invention is to make a thermal barrier for firearms, capable of protecting the polymeric structure thereof from the heat dissipated by the relative barrel.

The aforementioned purposes and others are substantially accomplished by a thermal barrier for firearms and by a firearm provided with such a thermal barrier as expressed and described in the following claims.

It is now provided the description of a preferred, but not exclusive embodiment, of a thermal barrier for firearms and of a firearm provided with such a thermal barrier, in accordance with the present invention.

Such a description will be made hereafter with reference to the attached drawings, provided for indicating and therefore not limiting purposes, in which.

Figure 1:
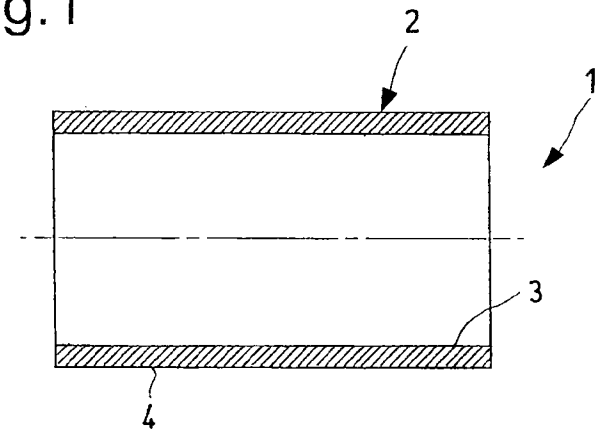
FIG. 1 is a schematic representation in section of a first example of a thermal barrier for firearms, in accordance with the present invention.

With reference to the attached figures, reference numeral 1 wholly indicates a thermal barrier for firearms, in accordance with the present invention.

Figure 2:
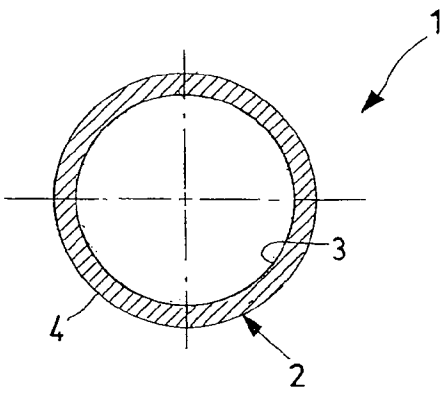
FIG. 2 is a cross section of the thermal barrier according to FIG. 1.

As can be seen in FIGS. 1 and 2, the thermal barrier 1 comprises at least one body 2, optionally substantially cylindrical, made of a ceramic material.

Figure 10:
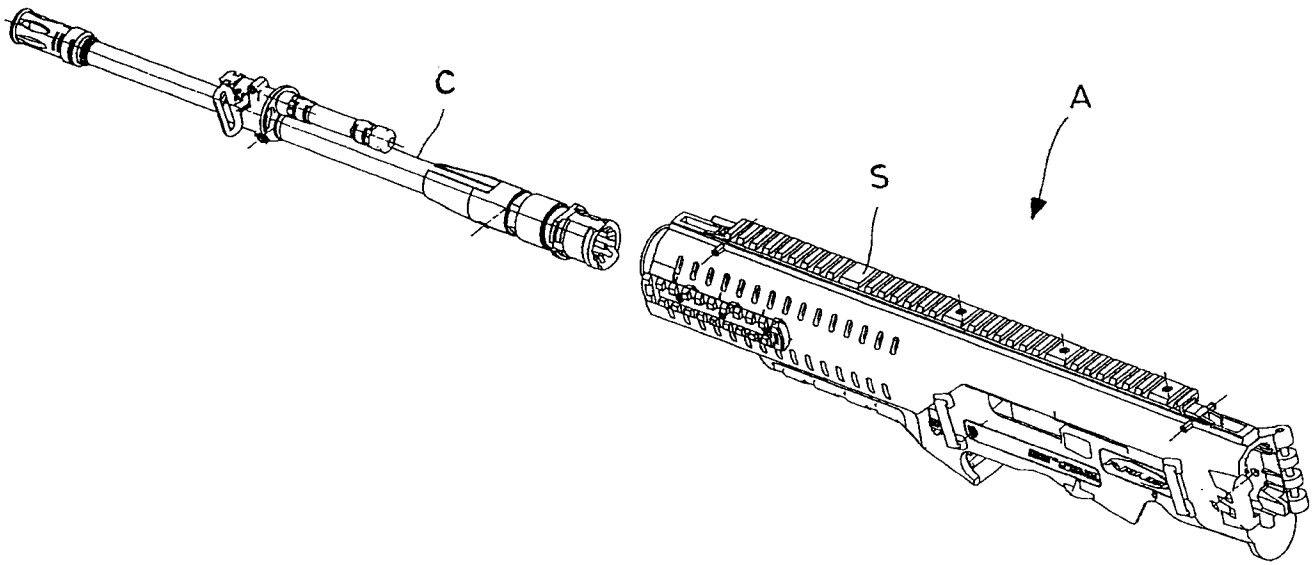
FIG. 10 is an exploded perspective representation of a firearm, in accordance with the present invention.
Figure 11:
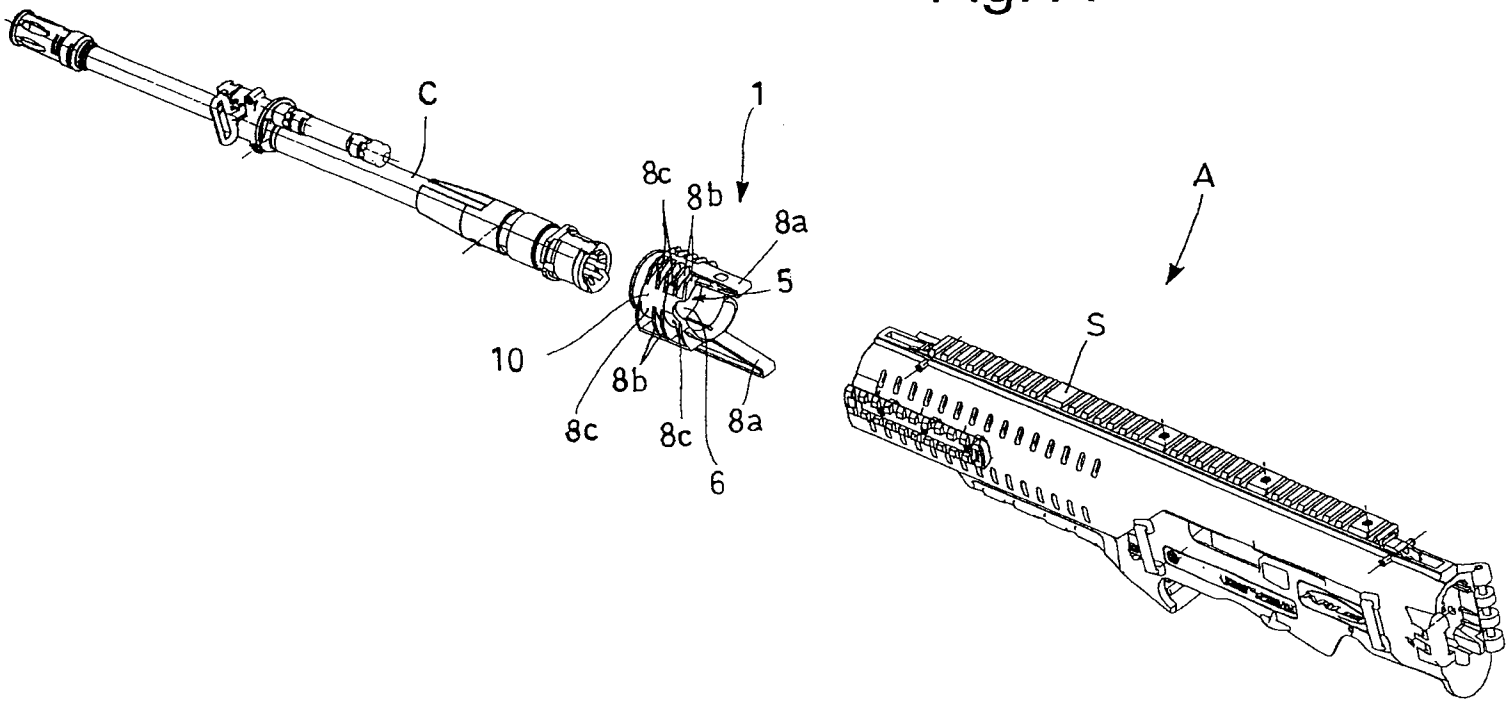
FIG. 11 is an exploded perspective representation of the firearm according to FIG. 10, provided with the thermal barrier illustrated in FIGS. 1 to 9.

The body 2 is advantageously shaped and configured for being placed between a respective barrel C of a firearm A (represented in FIGS. 10 and 11) and at least one structure S (also illustrated in FIGS. 10 and 11) thereof.

The body 2 of the thermal barrier 1 has a first portion 3 suitable for remaining facing the barrel C of the firearm A with which the thermal barrier itself is associated, and a second portion 4 facing the side opposite with respect to the first portion 3, i.e. suitable for remaining facing at least one portion of the structure S of the respective firearm A.

Advantageously, the second portion 4 of the body 2 of the thermal barrier 1 is suitable for bearing upon at least one portion of the structure S of the firearm A with which the aforementioned thermal barrier 1 is associated.

In accordance with the solution illustrated in FIGS. 1 to 6, both the first portion 3, and the second portion 4 of the body 2 of the thermal barrier 1 are defined by respective substantially cylindrical surfaces.

Advantageously, the ceramic material, which offers a high thermal barrier, can be placed between the parts made of steel (for example the barrel C) and the receiver S (for example made of a polymeric material) of the firearm A.

Even more advantageously, the ceramic material can be sprayed inside the receiver of the firearm, determining a ceramic film or layer intended for the thermal insulation of the parts of the firearm A directly involved.

Figure 3:
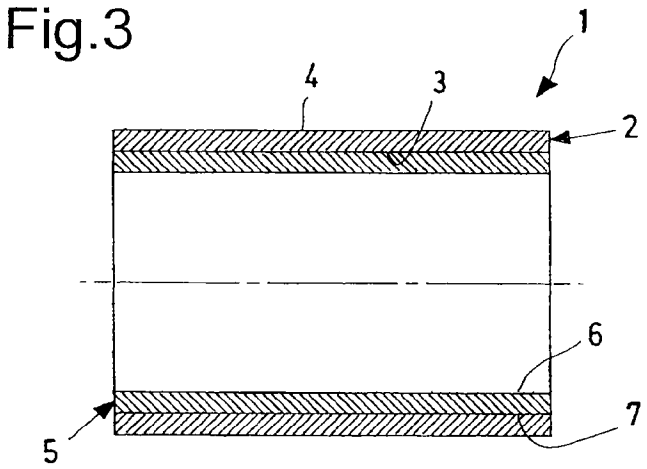
FIG. 3 is a schematic representation of a second example of a thermal barrier for firearms, in accordance with the present invention.
Figure 4:
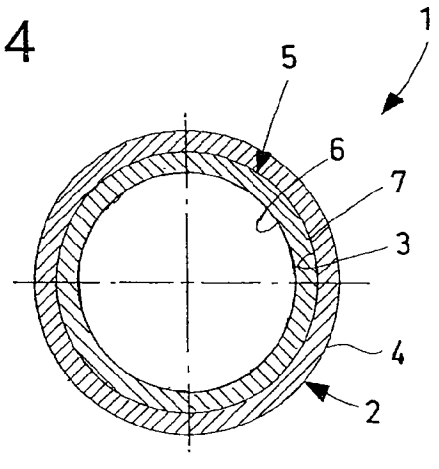
FIG. 4 is a cross section of the thermal barrier according to FIG. 3.
Figure 6:
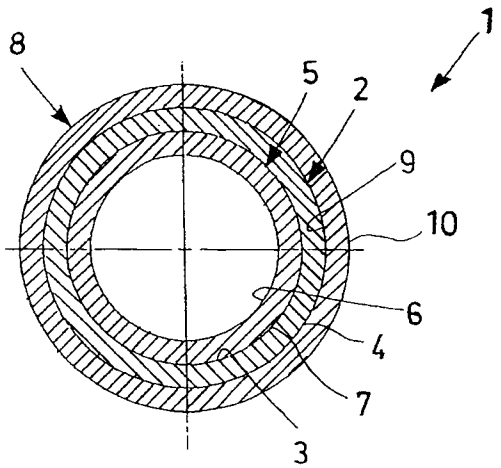
FIG. 6 is a cross section of the thermal barrier according to FIG. 5.

In accordance with the example embodiment illustrated in FIGS. 3 and 4, the thermal barrier 1 comprises a first element 5, in particular substantially tubular, made of a metal material, optionally steel.

As can be seen in FIGS. 3 and 4, the first element 5 has a substantially cylindrical internal surface 6, intended to engage the barrel C of the respective firearm A and, at least one outer surface 7 facing the side opposite the internal surface 6, optionally intended to engage, preferably directly, the first portion 3 of the body 2 of the thermal barrier 1. With reference to the solutions illustrated in FIGS. 5 to 9 and 11, the thermal barrier 1 advantageously comprises a second element 8, in particular substantially tubular, made of a polymeric material, optionally crosslinked.

The crosslinking of the polymeric material, through which the molecular structure of the polymers is modified, substantially increasing the resistance to high temperatures, can be obtained according to known processes of crosslinking, like for example through a process of irradiation of beta rays.

Preferably, the polymeric material of the second element 8 is filled with glass fibre and/or carbon fibre and/or any other fibre having similar characteristics.

Advantageously, the polymeric material of the second element 8 is a material with high thermal and structural resistance.

In detail, the second element 8 has an internal portion 9 that at least in part faces the second outer portion 4 of the body 2 of the thermal barrier 1, and an outer portion 10, facing the side opposite the internal portion 9, able to be engaged, in particular, with at least one portion of the structure S of the respective firearm A.

As represented in FIGS. 5 to 9, the body 2 of the thermal barrier 1 is placed between the first element 5 and the second element 8.

More in detail, the second portion 4 of the body 2 of the thermal barrier 1 can have at least one surface relief 4*a* (FIG. 9), preferably a plurality, for the engagement, optionally permanent, of the second element 8 with the body 2.

Preferably, the body 2 and the first element 5 of the thermal barrier 1 are joined to form a single piece, in particular through co-moulding.

Advantageously, the body 2 is joined to the first element 5 of the thermal barrier 1 by overmoulding the body 2 on the first element of the thermal barrier 1.

Advantageously, the body 2 and the second element 8 are joined to form a single piece, in particular by co-moulding.

In detail, the second element 8 is joined to the body 2 of the thermal barrier 1 by overmoulding it on the latter.

By overmoulding it is intended the moulding, according to known techniques, of structures made of polymeric material between two moulding shells in which the body 2 and the first element 5 are suitably positioned, suitably joined, around which, in particular around the body 2, the overmoulding of the second element 8 must be carried out.

Figure 5:
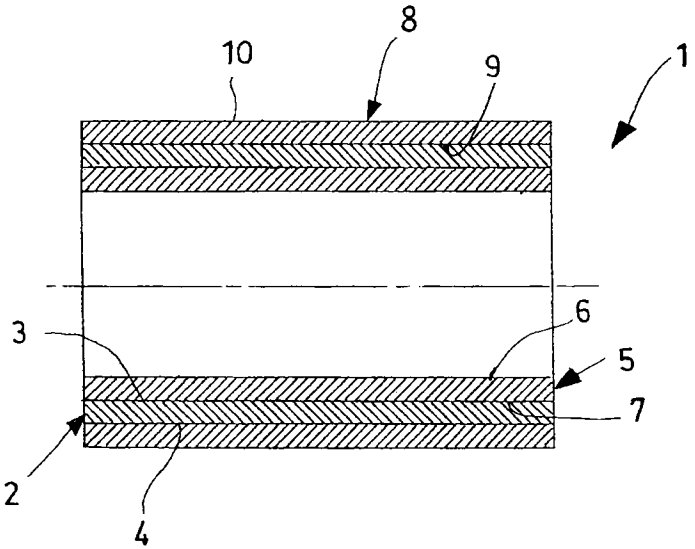
FIG. 5 is a schematic representation in section of a third example of the thermal barrier for firearms, in accordance with the present invention.
Figure 7:
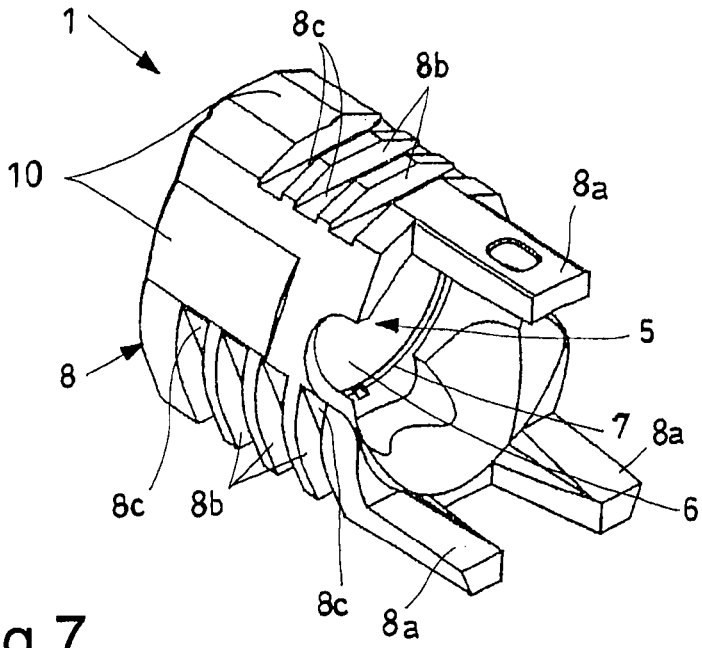
FIG. 7 is a perspective view of a fourth example of a thermal barrier for firearms, in accordance with the present invention.
Figure 8:
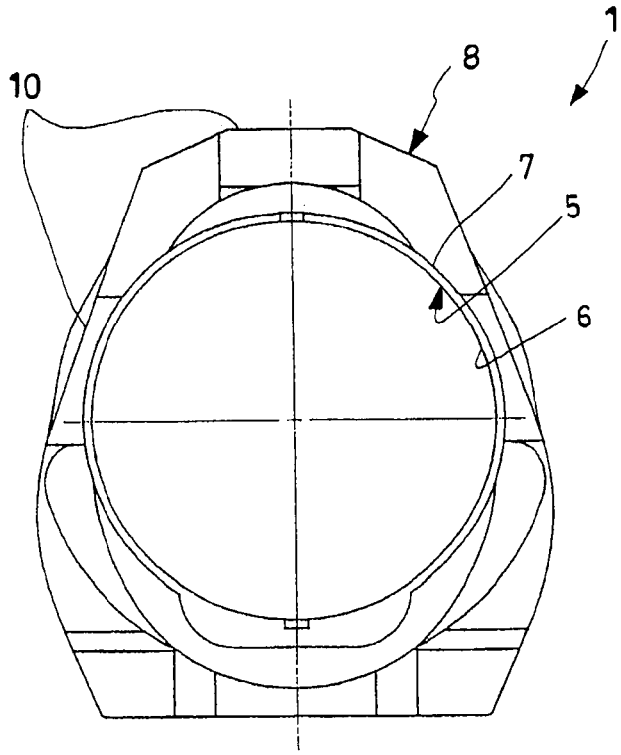
FIG. 8 is a front view of the thermal barrier according to FIG. 7.
Figure 9:
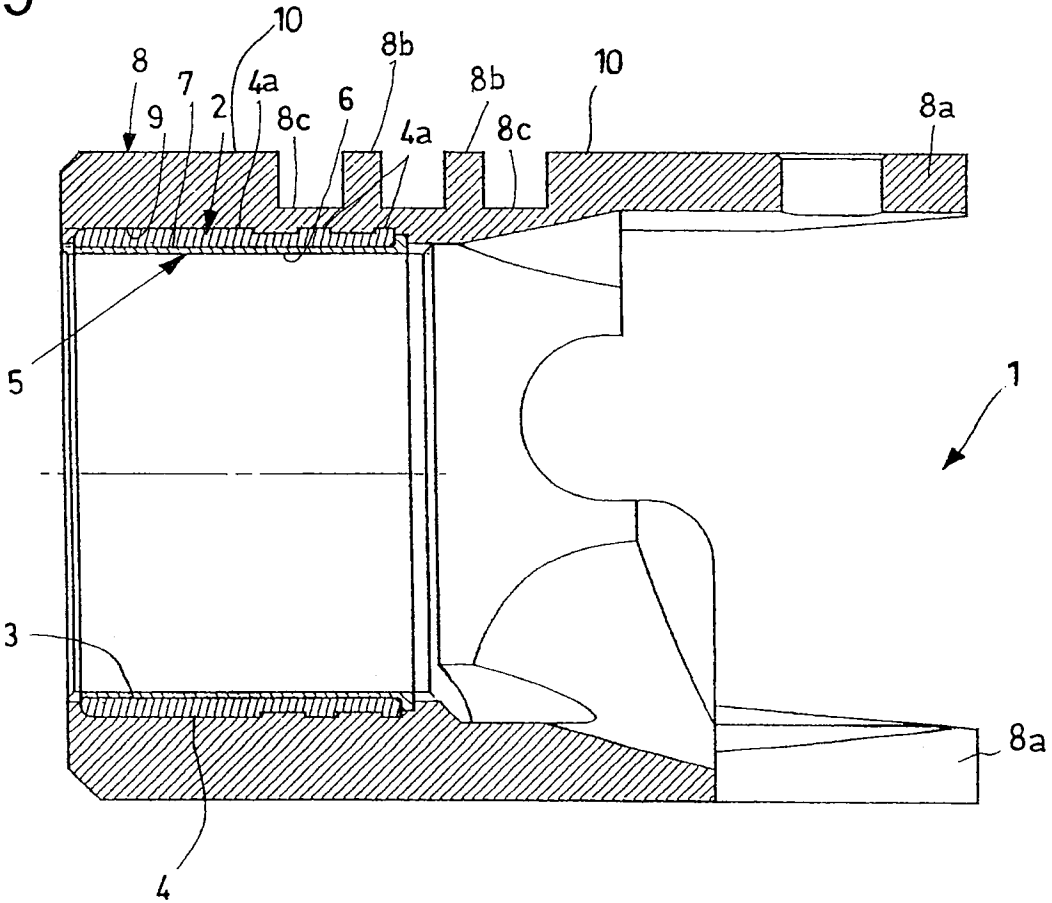
FIG. 9 is a longitudinal section of the thermal barrier according to FIGS. 7 and 8.

In accordance with the solution illustrated in FIGS. 5 and 9, the second element 8 is provided with engagement portions 8*a*, for example consisting of respective fastening and engagement appendages, as well as crests 8*b* and grooves 8*c* that offer a larger heat dispersion surface between the second element 8 and the receiver S (represented in FIGS. 10 and 11) of the firearm A with which the thermal barrier 1 is associated.

The thermal barrier according to the present invention solves the problems encountered in the prior art and achieves important advantages.

Firstly, the thermal barrier described above significantly increases the thermal break between the first metal element and the structure made of polymeric material of the firearm with which it is associated, as well as between the first metal element/barrel assembly of the firearm and the second element, also made of a polymeric material.

In particular, the presence of the body, made of a heat-resistant ceramic material, makes it possible to thermally insulate the structure made of polymeric material of the firearm from the barrel of the latter. In this way, every component made of polymeric material is protected from high overheating by the metal elements and/or components. The thermal insulation carried out by the ceramic body structurally safeguards both the second element made of polymeric material, and the structure of the respective firearm, ensuring the safety of users during use of the firearm.

The invention claimed is:

1. A thermal barrier for firearms, comprising:

at least one body made of a ceramic material, said body being positionable between a respective barrel of a firearm and at least one structure of said firearm, said body of said thermal barrier having a first portion suitable for remaining facing the barrel of said firearm, and a second portion facing the side opposite with respect to said first portion and suitable for bearing upon at least one portion of the structure of said firearm;

a first element made of a metal material, said first element having an internal substantially cylindrical surface which can be engaged at least partially on said barrel of said firearm and at least one outer surface facing the side opposite to said internal surface of said body, said outer surface being engaged to said body of said thermal barrier; and a second element made of a polymeric material, said second element having an internal portion facing, at least in part, said second portion of said body of said thermal barrier, and an external portion facing the side opposite to said internal portion, said external portion being engageable to a portion of said at least one structure of the respective firearm, said body of said thermal barrier being placed between said first and second elements.

2. The thermal barrier according to claim 1, wherein said second portion of said body of said thermal barrier has at least one surface relief, for engagement of said second element to said body.

3. The thermal barrier according to claim 2, wherein said body and second element are joined to form a single piece by said second element being overmoulded on said body.

4. The thermal barrier according to claim 3, wherein said body and said first element are joined to form a single piece.

5. The thermal barrier according to claim 3, wherein said polymeric material of said second element has at least one of a glass-fiber and carbon-fiber filler.

6. The thermal barrier according to claim 5, wherein said polymeric material of said second element is a material with high thermal and structural resistance.

7. The thermal barrier according to claim 3, wherein at least one part of the polymeric material of said second element has undergone a process of crosslinking.

8. The thermal barrier according to claim 1, wherein said ceramic material of said body of said thermal barrier comprises at least one ceramic film or layer, which can be set between a respective barrel and said at least one structure of said firearm, wherein said ceramic film or layer is provided within said structure of a respective firearm to remain between the latter and the respective barrel.

9. A firearm comprising:

at least one barrel made of a metal material; and at least one structure made of polymeric material;

further comprising at least one thermal barrier according to claim 1, said thermal barrier being placed between at least one part of said barrel and at least one part of said structure of said firearm.

* * * * *